US010451372B2

(12) United States Patent
Stetler

(10) Patent No.: US 10,451,372 B2
(45) Date of Patent: Oct. 22, 2019

(54) FIREARM CARTRIDGE CONVERSION SLEEVE

(71) Applicant: Jason Stetler, Oxnard, CA (US)

(72) Inventor: Jason Stetler, Oxnard, CA (US)

(73) Assignee: Stetler Firearms Company, LLC, Oxnard, CA (US)

( * ) Notice: Subject to any disclaimer, the term of this patent is extended or adjusted under 35 U.S.C. 154(b) by 0 days.

(21) Appl. No.: 16/148,667

(22) Filed: Oct. 1, 2018

(65) Prior Publication Data

US 2019/0101349 A1 Apr. 4, 2019

Related U.S. Application Data

(60) Provisional application No. 62/565,613, filed on Sep. 29, 2017.

(51) Int. Cl.
*F41A 21/12* (2006.01)
*F41A 33/00* (2006.01)

(52) U.S. Cl.
CPC ..... *F41A 21/12* (2013.01); *F41A 33/00* (2013.01)

(58) Field of Classification Search
CPC ..... F41A 33/00; F41A 21/10; F41A 21/26
USPC ..... 89/29
See application file for complete search history.

(56) References Cited

U.S. PATENT DOCUMENTS 329,793 A * 11/1885 Wheeler ..... 89/29
3,640,013 A * 2/1972 Franklin ..... F41A 21/10 102/446
5,479,737 A * 1/1996 Osborne ..... F41A 21/12 42/76.01
9,459,071 B2 * 10/2016 Hendricks ..... F42B 5/025

FOREIGN PATENT DOCUMENTS

FR 2249304 A1 * 5/1975 ..... F41A 21/10

* cited by examiner

*Primary Examiner* — Stephen Johnson
(74) *Attorney, Agent, or Firm* — Eversheds Sutherland (US) LLP

(57) ABSTRACT

A firearm conversion sleeve is disclosed. The firearm conversion sleeve may include a main body with a distal end, a body portion, and a proximate end. The firearm conversion sleeve may include a bore extending through the main body from the distal end to the proximate end. The firearm conversion sleeve may also include a collar on the distal end of the main body. The bore may be configured to receive a bullet cartridge.

14 Claims, 9 Drawing Sheets

FIREARM CARTRIDGE CONVERSION SLEEVE

CROSS-REFERENCE TO RELATED APPLICATIONS

The disclosure claims priority to and the benefit of U.S. Provisional Application No. 62/565,613, filed Sep. 29, 2017, which is hereby incorporated by reference herein in its entirety.

FIELD OF THE DISCLOSURE

The disclosure generally relates to a firearm and more particularly relates to firearm conversion sleeves of a firearm.

BACKGROUND

Cartridge inserts are used to allow a firearm owner to use different sized cartridges for similar caliber bullets with a particular firearm. The cartridge inserts are nonpermanent attachments to a firearm's barrel. Inserts can be used for rifles, shotguns, and pistols. The most common cartridge conversion inserts alter the length of the bullet cartridge used within the firearm. For example, a .32 automatic colt pistol bullet cartridge can be inserted into a .303 caliber insert. A .303 rifle can then fire the loaded .303 caliber insert. Problems with these types of cartridge inserts include the bullet not securely remaining inside the insert and the insert deforming over time. In addition, use of these conventional cartridge inserts causes an increased inefficiency when loading a firearm.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably and is not intended to be limiting.

DETAILED DESCRIPTION

Figure 1A:
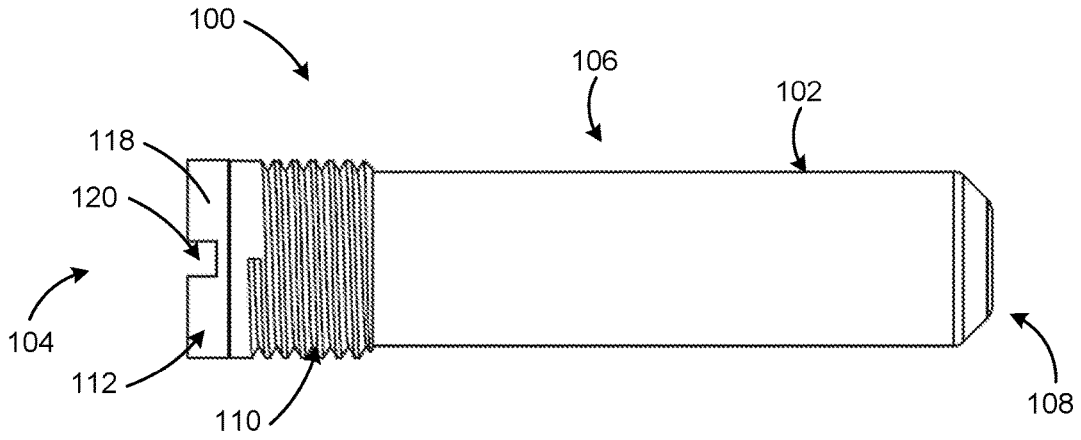
FIG. 1A depicts a side elevation view of a firearm cartridge conversion sleeve in accordance with one or more embodiments of the disclosure.

The disclosure is related to firearms and to a firearm conversion sleeve used with a firearm and configured to adjust a firearm to allow use of similar caliber bullets within different cartridges. For example, a firearm conversion sleeve may be configured to be slidably inserted into a firearm barrel to shoot .300 WINCHESTER MAGNUM cartridges. That is, the barrel of a particular firearm may be configured to receive a firearm conversion sleeve and a user may insert a firearm conversion sleeve to use a particular projectile that the firearm may not have been originally adapted to use within the receiver of the barrel. Methods of installing and using the firearm conversion sleeve are also disclosed. In some instances, the firearm conversion sleeve may be a quick attachment/detachment sleeve. For example, in certain embodiments, the firearm conversion sleeve may not require tools to attach the firearm conversion sleeve to the firearm. That is, a user may attach the firearm conversion sleeve by hand without the use of tools (i.e., toollessly). In other instances, a spanner wrench or other tool may be used to remove the firearm conversion sleeve from the barrel of the firearm. In this manner, once the firearm conversion sleeve is removed, the firearm barrel breech face may be exposed and accessible to a user. To attached the firearm conversion sleeve to the barrel of the firearm, the user may slide the firearm conversion sleeve within a slot of the barrel, twist the firearm conversion sleeve to lock it into place within the barrel, and the firearm may then receive a particular cartridge. One benefit of a nonpermanent insert is the continuous use of a firearm with different cartridges without degradation of the insert or the extra hassle of loading a cartridge insert with each shot.

The firearm configured to receive a firearm conversion sleeve may be any conventional firearm. For example, the firearm may be a .300 WINCHESTER MAGNUM rifle, a WINCHESTER Short MAGNUM bolt-action rifle, a 30-30 WINCHESTER rifle, a .308 WINCHESTER rifle, a .225 WINCHESTER rifle, a .222 REMINGTON rifle, or a .220 SWIFT rifle, among others. In some instances, the firearm may be a break-action, hinged-block, bolt-action, lever release, or rotating-drum action firearm, among others. In certain embodiments, the firearm conversion sleeve may be configured to be attached to a firearm's barrel. The firearm conversion sleeve may allow a firearm user to continuously load and fire a similar sized caliber bullet with a different sized cartridge in a firearm. In some instances, the firearm conversion sleeve may not swell after consistent and/or continuous discharge of the firearm. The firearm conversion sleeve may improve firearm loading efficiency over other types of cartridge converters.

Generally speaking, the firearm conversion sleeve may include a hollow cylindrical tube that can be attached to the breechface of a firearm's barrel. The hollow cylindrical tube may be open on the front end and open on the back end of the tube. That is, the hollow cylindrical tube may include an elongated bore extending through the length of the tube. The inner surface of the firearm conversion sleeve, forming the bore, that extends throughout the firearm conversion sleeve may be of different textures. For example, the inner surface of the bore may be smooth. In some instances, the firearm conversion sleeve may be rifled. The firearm conversion sleeve may have a textured outer surface on a collar disposed on one end of the firearm conversion sleeve for hand-tightening and removal of the firearm conversion sleeve. The textured outer surface may be knurled, ribbed, or lathed in another fashion. In some instances, the firearm conversion sleeve may have a textured outer surface that extends above the rest of the hollow cylindrical tube. For example, an aft end of the firearm conversion sleeve may include a collar having an outer diameter greater than the outer main body of the firearm conversion sleeve. In some instances, the outer circumferential surface of the collar may include the textured outer surface. The textured outer surface may provide a means for extracting the bullet cartridge. In certain instances, the firearm conversion sleeve may have a series of indentions on the collar capable of accepting prongs from a tool. In some instances, the firearm conversion sleeve may have a threaded surface to prevent slip within the firearm's barrel by using friction. The firearm conversion sleeve may have a means for adjusting the size of a cartridge that a firearm's barrel can receive. For example, the bore extending through the main body and the collar may be of varying diameters. In certain embodiments, the hollow cylindrical tube may taper on one end. The firearm conversion sleeve may include one or more alloys to prevent swelling of the firearm conversion sleeve within the firearm barrel.

In certain embodiments, the firearm conversion sleeve may include a main body that can include a distal end, a body portion, and a proximate end. That is, the firearm conversion sleeve may be a single, continuous piece of material (e.g., a main body) configured to be inserted into a firearm barrel. In this manner, the main body may extend from a distal end to a proximate end. The body portion may extend between the distal end and the proximate end. In some instances, firearm barrels may be configured to first receive the distal end of the firearm conversion sleeve. In other instances, firearm barrels may be configured to first receive the proximate end of the firearm conversion sleeve. In yet other instances, firearm barrels may be configured to receive either the proximate end or the distal end of the firearm conversion sleeve. In each embodiment, the firearm barrel may have an inner wall, at least a portion of which complements the size and/or shape of at least a portion of the firearm conversion sleeve. In some instances, the firearm conversion sleeve may taper at one end. In other instances, the firearm conversion sleeve may be flat at one or more ends.

In certain embodiments, the firearm conversion sleeve may include a threaded outer surface configured to threadably engage a firearm barrel. For example, the firearm conversion sleeve may include a threaded outer surface on the proximate end of and covering a portion of the main body. The firearm barrel may include a complementary threaded inner surface configured to threadably engage the threaded outer surface on the firearm conversion sleeve. For example, a breechface end of the firearm barrel may include a slot with a threaded inner surface at an end of the slot opposite the breechface. The threaded inner surface of the slot may threadably engage the threaded outer surface of the firearm conversion sleeve to secure the firearm conversion sleeve to the barrel. The threading disposed on the slot and the firearm conversion sleeve may be fine or coarse thread and can be any of a variety of thread pitches or counts. In some instances, the threaded outer surface of the firearm conversion sleeve may be on the distal end and cover a portion of the main body of the firearm conversion sleeve. In other instances, the threaded surface may be on the proximate end or body portion of the firearm conversion sleeve. In other examples, the threaded outer surface may extend the length of the main body of the firearm conversion sleeve or may extend any other length along the firearm conversion sleeve. In certain embodiments, the firearm conversion sleeve and the slot may have another means to engage and be coupled to each other, such as a ball and detent, friction fit, tab, or other fastener. The threaded outer surface may accept single thread, double thread, or triple thread design. Furthermore, the barrel's threaded inner surface may accept unified, metric, square, ACME, or buttress threading forms, among others.

In certain embodiments, the firearm conversion sleeve may include a lip disposed along the main body. In some instances, the lip may be formed by a collar disposed on one end of the firearm conversion sleeve. For example, the collar may extend perpendicularly and/or radially away from the body portion of the firearm conversion sleeve. In some instances, the collar may extend radially outward from the body portion of the firearm conversion sleeve at any angle between 1-179 degrees. In this manner, the lip may prevent the firearm conversion sleeve from sliding within the firearm barrel. In some instances, the firearm conversion sleeve may include two or more lips. For example, the firearm conversion sleeve may include a radially inwardly recessed surface or depression along the body portion to form a second lip. In other instances, the firearm conversion sleeve may not include a lip.

In certain embodiments, the firearm conversion sleeve may be cylindrical or substantially cylindrical. That is, the distal end, the body portion, the proximate portion, and each component described herein may be cylindrical or substantially cylindrical. In some instances, the firearm conversion sleeve and the components thereof may all have similar cross-sectional shapes, such as circles, rectangles, squares, or triangles. In other instances, the firearm conversion sleeve and the components thereof may all have different cross-sectional shapes, such as circles, rectangles, squares, or triangles.

In certain embodiments, the firearm conversion sleeve may include a collar. For example, the collar may be defined by a surface extending generally radially outward from the firearm conversion sleeve and/or protrude from the breechface of the firearm barrel when the firearm conversion sleeve is engaged with or coupled to the barrel. In other instances, the outer surface of the collar may be flush with the outer surface of the body portion of the firearm conversion sleeve. The collar may be cylindrical. In other instances, the outer surface of the collar may be some other shape, such as triangular, rectangular, oval, or some other geometric shape. In certain embodiments, the collar of the firearm conversion sleeve may include a textured outer surface configured to help a user tighten the firearm conversion sleeve to a firearm barrel. In some instances, the textured outer surface of the collar may be a knurled surface. In other instances, the textured outer surface of the collar may be scratched, smooth, include a series of ridges, or some other texture thereon.

In certain embodiments, the collar of the firearm conversion sleeve may include at least one notch. That is, the at least one notch may be disposed and/or etched into the collar. In some instances, the notch may be configured to receive an extractor to remove a spent cartridge from within the firearm conversion sleeve. In another example, the firearm conversion sleeve may include two notches configured to receive a spanner wrench or other tool. In this manner, the at least one notch may improve the user's ability to attach and/or remove the firearm conversion sleeve from the firearm barrel. In other instances, the at least one notch may improve the user's ability to insert and/or remove cartridges from within the firearm conversion sleeve. In some instances, each of the at least one notch may be circular. In other instances, each notch may be another shape such as rectangular, triangular, hexagonal or some other geometric shape. The at least one notch may be configured to receive one or more tools such as a crescent wrench, a flathead screwdriver, or some other tool.

In certain embodiments, the collar of the firearm conversion sleeve may include one or more indentions. For example, the one or more indentions may be disposed and/or etched into the collar. In some instances, the indention may be configured to receive an extractor. In this manner, the one or more indentions may improve the user's ability to attach and/or remove the firearm conversion sleeve from the firearm barrel. In some instances, each of the one or more indentions may be semi-circular. In other instances, each of the one or more indentions may be rectangular, triangular, square, or some other geometric shape. The one or more indentions may be configured to receive one or more tools such as a spanner wrench, crescent wrench, flathead screwdriver, or some other tool.

In certain embodiments, a firearm conversion assembly includes a firearm barrel. For example, the firearm barrel may be disposed on one end of the firearm with a breechface end, a muzzle end, and a slot. In some instances, the slot may include a threaded inner surface configured to engage a threaded outer surface of the firearm conversion sleeve. In this manner, the slot may have an opening with a larger diameter than the diameter of a bore extending the length of the firearm barrel. In other instances, the slot may be a smooth inner surface rather than threaded inner surface. In certain embodiments, the slot may extend from the breechface end of the firearm barrel towards the muzzle end. In some instances, the threaded inner surface of the slot may be on the breechface end of the slot. In other instances, the threaded inner surface may be opposite the breechface end of the slot. The slot may or may not include a taper at one end.

In some embodiments, the firearm conversion sleeve 100 may configured to receive a cartridge for a .300 WINCHESTER MAGNUM rifle (e.g., FIGS. 1A-1C), a WINCHESTER Short MAGNUM bolt-action rifle (e.g., FIGS. 2A-2C), a 30-30 WINCHESTER rifle (e.g., FIGS. 3A-3C), or a .308 WINCHESTER rifle (e.g., FIGS. 4A-4C), among others.

Figure 1B:
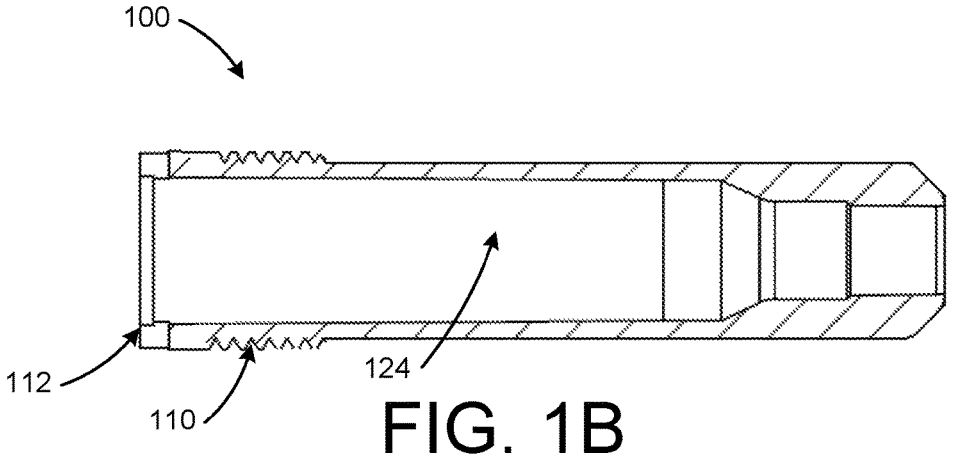
FIG. 1B depicts a cross-sectional view of the firearm cartridge conversion sleeve of FIG. 1A in accordance with one or more embodiments of the disclosure.
Figure 1C:
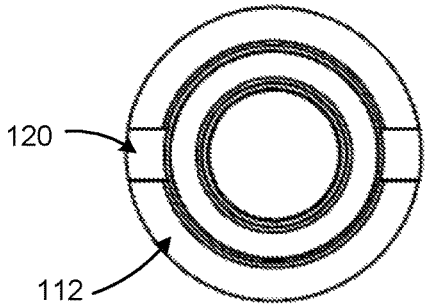
FIG. 1C depicts a distal end plan view of the firearm cartridge conversion sleeve of FIG. 1A in accordance with one or more embodiments of the disclosure.

FIGS. 1A-1C depict various views of a firearm conversion sleeve 100 in accordance with one or more embodiments of the disclosure. In some embodiments, as shown in FIGS. 1A-1C, the firearm conversion sleeve 100 includes a main body 102. The main body 102 may include a distal end 104 extending to a proximate end 108. Between the distal end 104 and the proximate end 108 may be a body portion 106. The main body 102 can also include an outer wall surface, an inner wall surface and a bore or channel that extends from the distal end 104 to the proximate end 108. The proximate end 108 of the main body 102 may be tapered at various angles towards the bore 124. In some instances, the main body 102 may be cylindrical throughout the firearm conversion sleeve 100. In other instances, the main body 102 may be another geometric shape.

In some embodiments, as shown in FIG. 1A, the firearm conversion sleeve 100 may include a collar 112 disposed on the distal end 104 of the firearm conversion sleeve 100. The collar 112 may be disposed on the distal end 104, the body portion 106, and/or the proximate end 108. In some instances, the collar 112 may include at least one notch 120. That is, the notch 120 may be configured to extract a cartridge and/or be configured to help secure via a tool the firearm conversion sleeve 100 to a firearm barrel. The collar 112 may include a textured outer surface 118. The textured outer surface 118 may be smooth, knurled, ribbed, or lathed in another fashion. In some instances, the firearm conversion sleeve 100 may have a textured outer surface that extends above the rest of the hollow cylindrical tube. In other instances, the firearm conversion sleeve 100 may have a textured outer surface 118 that is level with the body portion 106. Adjacent to the collar 112, the body portion 106 may be a threaded outer surface 110 disposed along the outer wall surface of the main body 102 and configured to threadably engage with another threaded surface within a firearm barrel slot, discussed herein. The threaded outer surface 110 may be disposed along any portion of the main body 102 of the firearm conversion sleeve 100. The threading of the threaded outer surface 110 may be fine or coarse thread and can be any of a variety of thread pitches or counts. The threaded outer surface 110 may accept single thread, double thread, or triple thread design. In some instances, the firearm conversion sleeve 100 may not include a lip (e.g., as shown in FIGS. 2A-2B).

The firearm conversion sleeve 100 may be constructed from any suitable material or combination of materials. The firearm conversion sleeve 100 may be made from one or more alloys, including, but not limited to, steel, bronze, copper, tin, brass, or zinc, among others. The conversion sleeve 100 may be any suitable material or combination of materials.

Figure 2A:
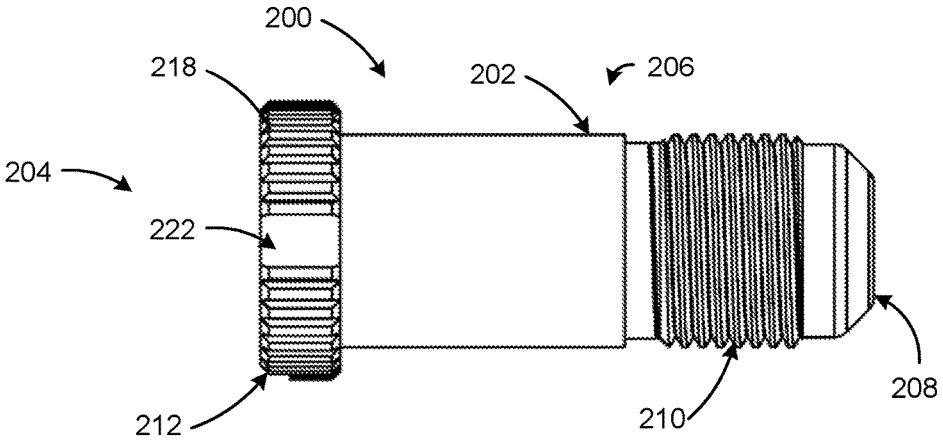
FIG. 2A depicts a side elevation view of another firearm cartridge conversion sleeve in accordance with one or more embodiments of the disclosure.
Figure 2B:
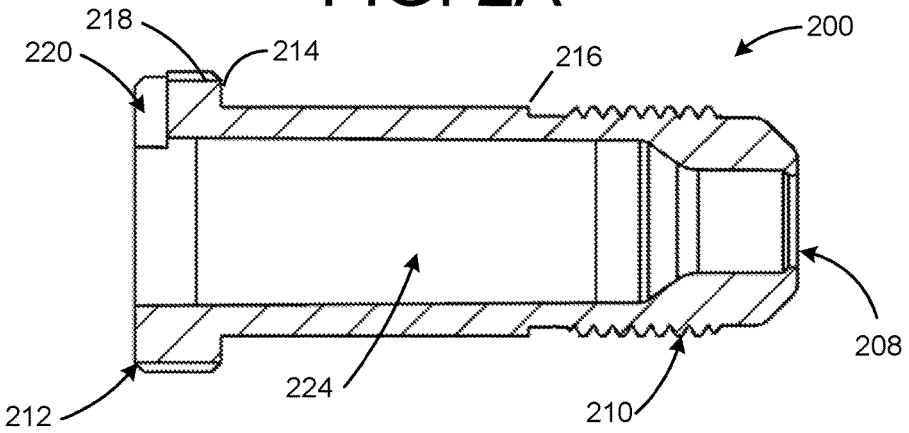
FIG. 2B depicts a cross-sectional view of the firearm cartridge conversion sleeve of FIG. 2A in accordance with one or more embodiments of the disclosure.
Figure 2C:
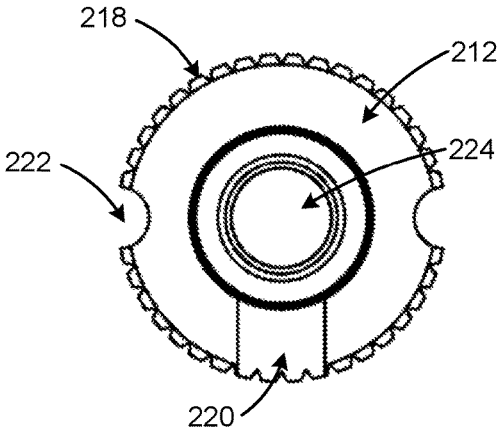
FIG. 2C depicts a distal end plan view of the firearm cartridge conversion sleeve of FIG. 2A in accordance with one or more embodiments of the disclosure.

FIGS. 2A-2C depict various views of another firearm cartridge conversion sleeve 200 in accordance with one or more embodiments of the disclosure. In some embodiments, as shown in FIGS. 2A-2C, the firearm conversion sleeve 200 includes a main body 202. The main body 202 may include a distal end 204 extending to a proximate end 208. A body portion 206 may extend between the distal end 204 and the proximate end 208. The main body 202 can also include an outer wall surface, an inner wall surface and a bore or channel 224 that extends from the distal end 204 to the proximate end 208. In some instances, the bore 224 within the firearm conversion sleeve 200 may complement a particular cartridge for a bullet. In other instances, the bore 224 may form another shape. The proximate end 208 of the main body 202 may be tapered towards the bore 224 and configured to receive a particular bullet cartridge (e.g., a .300 WINCHESTER Short MAGNUM cartridge). In some instances, the main body 202 may be cylindrically shaped throughout the firearm conversion sleeve 200. In other instances, the main body 202 may be another geometric shape.

In some embodiments, as shown in FIG. 2A, the firearm conversion sleeve 200 may include a collar 212 disposed on the distal end 204 of the firearm conversion sleeve 200. In other embodiments, the collar 212 may be disposed on the body portion 206 and/or the proximate end 208. The collar 212 can include an outer surface that extends out radially from the outer surface of the main body 202 and has an outer diameter that is greater than the outer diameter of the main body 202. In some instances, the collar 212 may include at least one notch 220 and one or more indentions 222. In one example, each of the at least one notch 220 can be disposed along a top surface of the collar 212 and extend axially inward from the top surface. In some embodiments, as shown in FIG. 2C, the at least one notch 220 may extend from an outer circumferential side surface of the collar 212 to the bore 224. In other instances, the at least one notch 220 may extend some other distance along the face of the collar 212 or may be disposed along a different portion of the main body 202. In one example, each of the one or more indentions 222 can extend radially inward from an outer circumferential side surface of the collar 212. In certain examples, the notch 220 and the one or more indentions 222, alone or separately may be configured to extract a cartridge and/or be configured to help secure via a tool the firearm conversion sleeve 200 to a firearm barrel. The collar 212 may include a textured outer surface 218. The textured outer surface 218 may be smooth, knurled, ribbed, or lathed in another fashion. In some instances, the firearm conversion sleeve 200 may have a textured outer surface that extends above the rest of the hollow cylindrical tube. In other instances, the firearm conversion sleeve 200 may have a textured outer surface 218 that is level with the body portion 106.

In certain embodiments, a threaded outer surface 210 may be provided along the outer wall surface of the main body 202 adjacent to the proximate end 208. The threaded outer surface 210 may be configured to threadably engage with another threaded surface within a firearm barrel slot, discussed herein. In other embodiments, the threaded outer surface 210 may be disposed along any portion of the main body 202 of the firearm conversion sleeve 200. The threading of the threaded outer surface 210 may be fine or coarse thread and can be any of a variety of thread pitches or counts. The threaded outer surface 210 may accept single thread, double thread, or triple thread design.

In some embodiments, as shown in FIG. 2B, the firearm conversion sleeve also includes a first lip 214 and a second lip 216. In one example, the second lip 216 can be disposed adjacent to the threaded outer surface 210. In certain examples, each lip may form a 90 degree angle with the outer wall surface of the main body 202. Each lip may form a different angle greater or less than 90 degrees with the outer wall surface of the main body 202.

In some embodiments, as shown in FIG. 2C, the at least one notch 220 may extend from an exterior surface of the collar 212 to the bore 224. In some instances, the at least one notch 220 may extend some other distance of the collar 212 or may be disposed along a different portion of the main body 202.

Figure 3A:
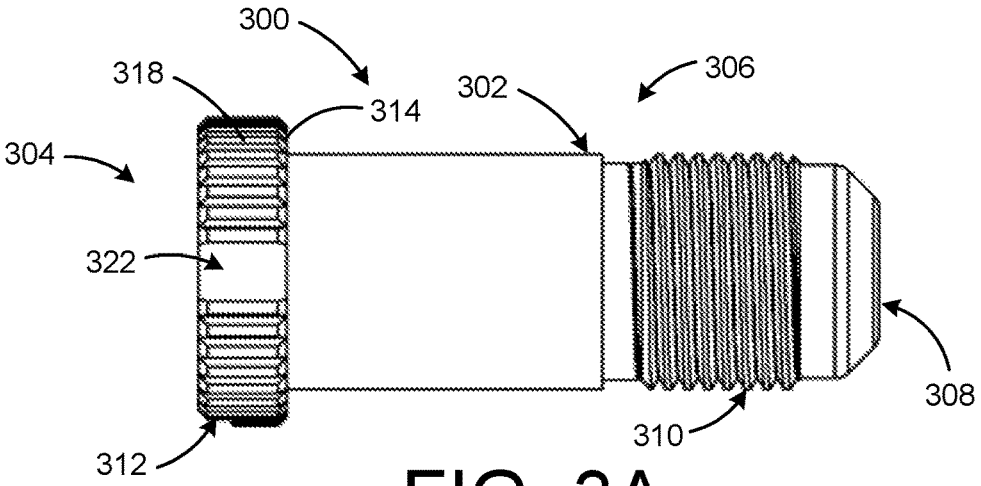
FIG. 3A depicts a side elevation view of yet another firearm cartridge conversion sleeve in accordance with one or more embodiments of the disclosure.
Figure 3B:
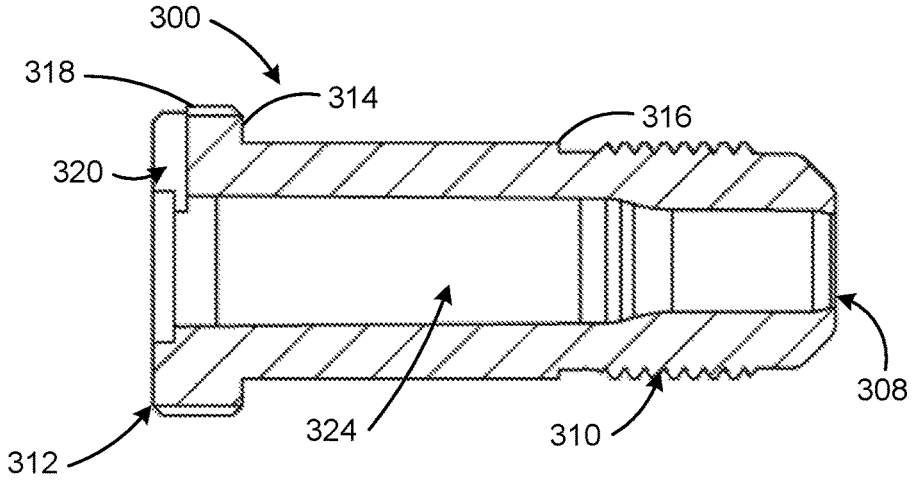
FIG. 3B depicts a cross-sectional view of the firearm cartridge conversion sleeve of FIG. 3A in accordance with one or more embodiments of the disclosure.
Figure 3C:
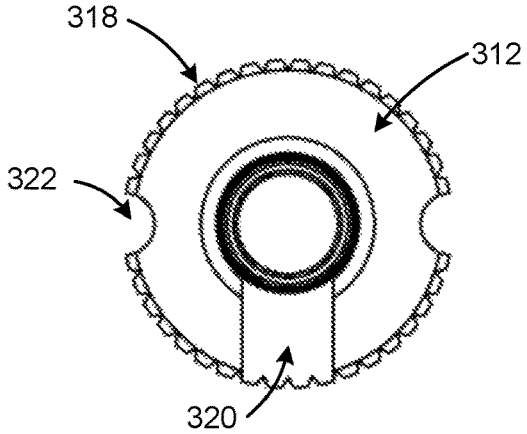
FIG. 3C depicts a distal end plan view of the firearm cartridge conversion sleeve of FIG. 3A in accordance with one or more embodiments of the disclosure.

FIGS. 3A-3C depict various views of another firearm cartridge conversion sleeve 300 in accordance with one or more embodiments of the disclosure. In some embodiments, as shown in FIGS. 3A-3C, the firearm conversion sleeve 300 includes a main body 302. The main body 302 may include a distal end 304 extending to a proximate end 308. Between the distal end 304 and the proximate end 308 may be a body portion 306. The main body 302 can also include an outer wall surface, an inner wall surface, and a bore or channel 324 that extends from the distal end 304 to the proximate end 308. The proximate end 308 of the main body 302 may be tapered towards the bore 324 and configured to receive a particular bullet cartridge (e.g., a 30-30 Winchester). In some instances, the main body 302 may be cylindrically shaped throughout the firearm conversion sleeve 300. In other instances, the main body 302 may be another geometric shape.

In some embodiments, as shown in FIG. 3A, the firearm conversion sleeve 300 may include a collar 312 disposed on the distal end 304 of the firearm conversion sleeve 300. The collar 312 may be disposed on the distal end 304, the body portion 306, and/or the proximate end 308. The collar 312 may include an outer surface that extends out radially from the outer surface of the main body 302 and has an outer diameter that is greater than the outer diameter of the main body 302. In some instances, the collar 312 may include at least one notch 320, one or more indentions 322, and a textured outer surface 318. In some instances, each of the at least one notch 320 can be disposed along a surface of the collar 312 and extend axially inward from the surface. In some embodiments, as shown in FIG. 3C, the at least one notch 320 may extend from an outer circumferential side surface of the collar 312 to the bore 324. In other instances, the at least one notch 320 may extend some other distance along the face of the collar 312 or may be disposed along a different portion of the main body 302. In one example, each of the one or more indentions 322 can extend radially inward from an outer circumferential side surface of the collar 312. That is, the notch 320 and the one or more indentions may be configured to extract a cartridge and/or be configured to help secure via a tool the firearm conversion sleeve 300 to a firearm barrel.

In some embodiments, the textured outer surface 318 may be configured to provide grip to a user. The textured outer surface 318 may be smooth, knurled, ribbed, or lathed in another fashion. In some instances, the firearm conversion sleeve 300 may have a textured outer surface that extends above the rest of the hollow cylindrical tube. In other instances, the firearm conversion sleeve 300 may have a textured outer surface 318 that is level with the body portion 306. Adjacent to the proximate end 308 may be a threaded outer surface 310 configured to engage with another threaded surface within a firearm barrel slot, discussed herein. The threaded outer surface 310 may be disposed along any portion of the main body 302 of the firearm conversion sleeve 300. The threading of the threaded outer surface 310 may be fine or coarse thread and can be any of a variety of thread pitches or counts. The threaded outer surface 310 may accept single thread, double thread, or triple thread design.

In some embodiments, as shown in FIG. 3B, the firearm conversion sleeve includes a first lip 314 and a second lip 316. In one embodiment, the first lip 314 can be defined by the intersection of the collar 312 and the main body 302 and can be a portion of a bottom wall surface of the collar 312. In one embodiment, the first lip 314 can be defined by the intersection of the collar 312 and the main body 302 and can be a portion of a bottom wall surface of the collar 312. In one example, the second lip 316 can be disposed adjacent to the threaded outer surface 310. Each lip may form a 90 degree angle with the exterior surface of the firearm conversion sleeve 300. Each lip may form a different angle greater or less than 90 degrees with the surface of the firearm conversion sleeve 300. In some instances, the bore 324 within the firearm conversion sleeve 300 may complement a particular cartridge for a bullet. In other instances, the bore 324 may form another shape.

In some embodiments, as shown in FIG. 3C, the at least one notch 320 may extend from an exterior surface of the collar 312 to the bore 324. In some instances, the at least one notch 320 may extend some other distance of the collar 312 or may be disposed along a different portion of the main body 302.

Figure 4A:
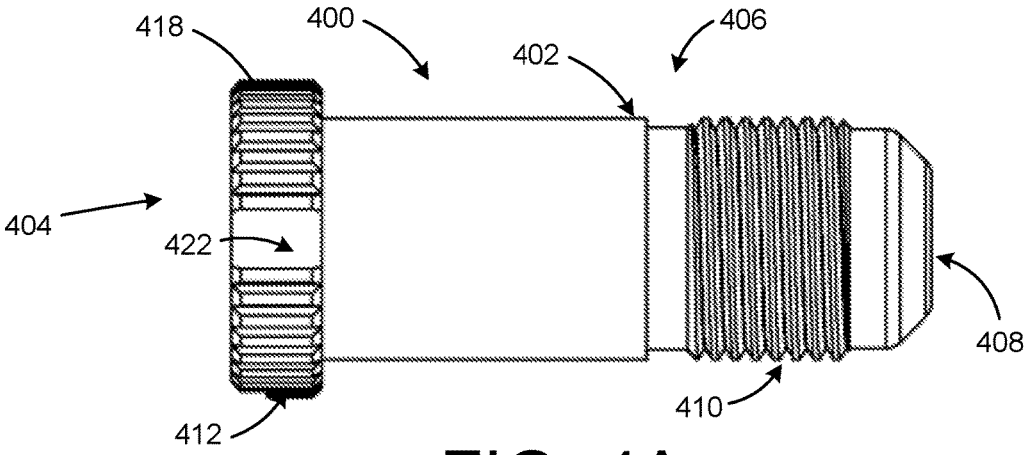
FIG. 4A depicts a side elevation view of another firearm cartridge conversion sleeve in accordance with one or more embodiments of the disclosure.
Figure 4B:
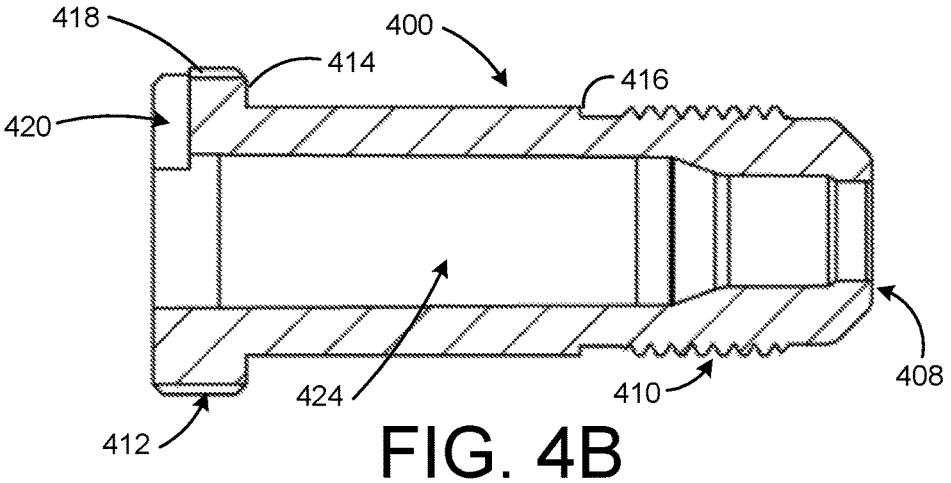
FIG. 4B depicts a cross-sectional view of the firearm cartridge conversion sleeve of FIG. 4A in accordance with one or more embodiments of the disclosure.
Figure 4C:
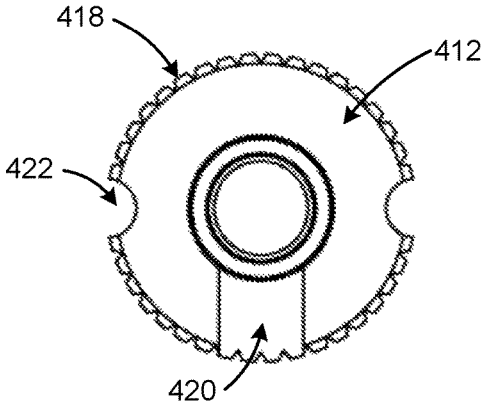
FIG. 4C depicts a distal end plan view of the firearm cartridge conversion sleeve of FIG. 4A in accordance with one or more embodiments of the disclosure.
Figure 5A:
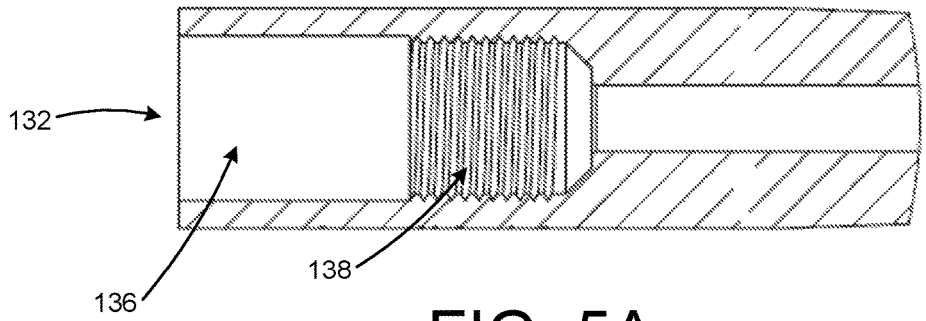
FIG. 5A depicts a partial cross-sectional view of a firearm barrel configured to accept a firearm cartridge conversion sleeve in accordance with one or more embodiments of the disclosure.
Figure 5B:
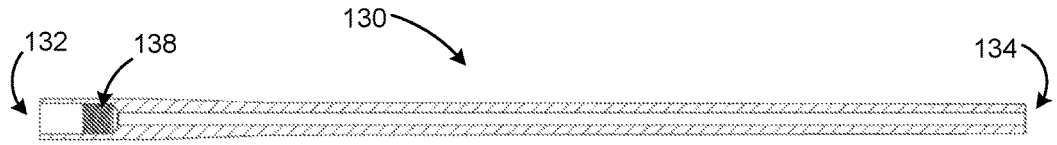
FIG. 5B depicts a cross-sectional view of the firearm barrel of FIG. 5A in accordance with one or more embodiments of the disclosure.
Figure 5C:
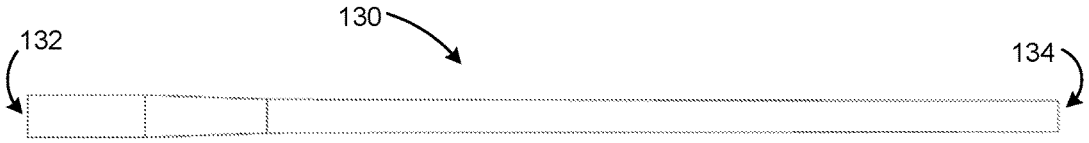
FIG. 5C depicts a side elevation view of the firearm barrel of FIG. 5B in accordance with one or more embodiments of the disclosure.
Figure 5D:
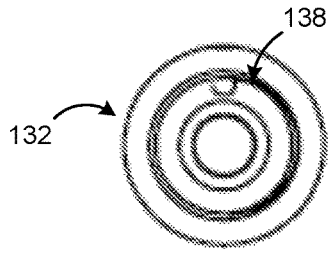
FIG. 5D depicts a plan view of a breechface end of the firearm barrel of FIG. 5B configured to accept a firearm cartridge conversion sleeve in accordance with one or more embodiments of the disclosure.

FIGS. 4A-4C depict various views of another firearm cartridge conversion sleeve 400 in accordance with one or more embodiments of the disclosure. In some embodiments, as shown in FIGS. 4A-4C, the firearm conversion sleeve 400 includes a main body 402. The main body 402 may include a distal end 404 extending to a proximate end 408. Between the distal end 404 and the proximate end 408 may be a body portion 406. The main body 402 can also include an outer wall surface, an inner wall surface, and a bore or channel 424 that extends from the distal end 404 to the proximate end 408. The proximate end 408 of the main body 402 may be tapered towards the bore 424 and configured to receive a particular bullet cartridge (e.g., e.g., a .308 WINCHESTER). In some instances, the main body 402 may be cylindrically shaped throughout the firearm conversion sleeve 400. In other instances, the main body 402 may be another geometric shape.

In some embodiments, as shown in FIG. 4A, the firearm conversion sleeve 400 may include a collar 412 disposed on the distal end 404 of the firearm conversion sleeve 400. The collar 412 may be disposed on the distal end 404, the body portion 406, and/or the proximate end 408. The collar 412 may include an outer surface that extends out radially from the outer surface of the main body 402 and has an outer diameter that is greater than the outer diameter of the main body 402. In some instances, the collar 412 may include at least one notch 420, one or more indentions 422, and a textured outer surface 418. In some instances, each of the at least one notch 420 can be disposed along a surface of the collar 412 and extend axially inward from the surface. In some embodiments, as shown in FIG. 4C, the at least one notch 420 may extend from an outer circumferential side surface of the collar 412 to the bore 424. In other instances, the at least one notch 420 may extend some other distance along the face of the collar 412 or may be disposed along a different portion of the main body 402. In one example, each of the one or more indentions 422 can extend radially inward from an outer circumferential side surface of the collar 412. That is, the notch 420 and the one or more indentions may be configured to extract a cartridge and/or be configured to help secure via a tool the firearm conversion sleeve 400 to a firearm barrel.

In some embodiments, the textured outer surface 418 may be configured to provide grip to a user. The textured outer surface 418 may be smooth, knurled, ribbed, or lathed in another fashion. In some instances, the firearm conversion sleeve 400 may have a textured surface that extends above the rest of the hollow cylindrical tube. In other instances, the firearm conversion sleeve 400 may have a textured outer surface 418 that is level with the body portion 406. Adjacent to the proximate end 408 may be a threaded outer surface 410 configured to engage with another threaded surface within a firearm barrel slot, discussed herein. The threaded outer surface 410 may be disposed along any portion of the main body 402 of the firearm conversion sleeve 400. The threading of the threaded outer surface 410 may be fine or coarse thread and can be any of a variety of thread pitches or counts. The threaded outer surface 410 may accept single thread, double thread, or triple thread design.

In some embodiments, as shown in FIG. 4B, the firearm conversion sleeve includes a first lip 414 and a second lip 416. In one example, the second lip 416 can be disposed adjacent to the threaded outer surface 410. In one embodiment, the first lip 414 can be defined by the intersection of the collar 412 and the main body 402 and can be a portion of a bottom wall surface of the collar 412. Each lip may form a 90 degree angle with the exterior surface of the firearm conversion sleeve 400. Each lip may form a different angle greater or less than 90 degrees with the surface of the firearm conversion sleeve 400. In some instances, the bore 424 within the firearm conversion sleeve 400 may complement a particular cartridge for a bullet. In other instances, the bore 424 may form another shape.

In some embodiments, as shown in FIG. 4C, the at least one notch 420 may extend from an exterior surface of the collar 412 to the bore 424. In some instances, the at least one notch 420 may extend some other distance of the collar 412 or may be disposed along a different portion of the main body 402.

In some embodiments, as shown in FIGS. 5A-5D, a firearm conversion sleeve assembly includes a firearm barrel 130 configured to receive a firearm conversion sleeve. For example, the firearm barrel 130 may include a breechface end 132 and a muzzle end 134. In some instances, the breechface end 132 may receive the firearm conversion sleeve described herein. In other instances, the firearm barrel 130 may be configured to receive another type of firearm conversion sleeve. In this manner, the firearm barrel 130 may include a slot 136 configured to engage the firearm conversion sleeve. That is, the slot 136 may include a threaded surface 138 configured to secure a threaded surface on the firearm conversion sleeve. The threaded surface 138 may be disposed anywhere along the surface of the slot 136. Extending from the slot 136 may be a bore extending therefrom to the muzzle end 134 of the firearm barrel 130. In this manner, the bore 124 (e.g., as shown in FIG. 1) diameter at the proximate end 108 may complement the bore within the firearm barrel 130. In this manner, when a firearm is discharged, the bullet may travel from the cartridge within the firearm conversion sleeve towards the muzzle end 134 of the firearm barrel 130.

Figure 6A:
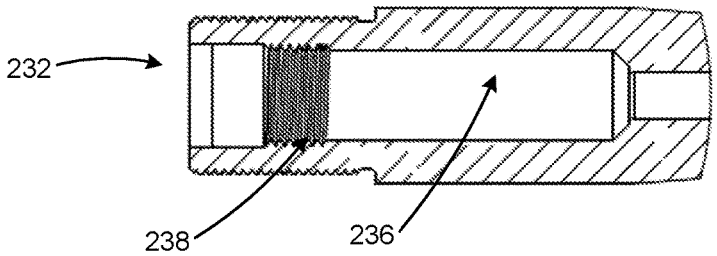
FIG. 6A depicts a partial cross-sectional view of another firearm barrel configured to accept a firearm cartridge conversion sleeve in accordance with one or more embodiments of the disclosure.
Figure 6B:
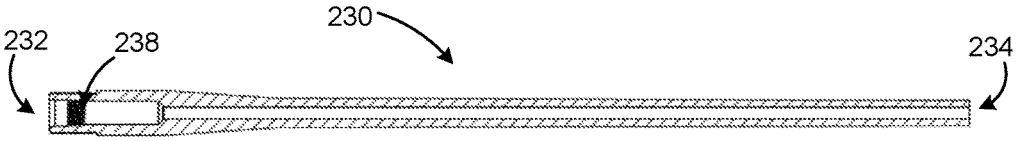
FIG. 6B depicts a cross-sectional view of the firearm barrel of FIG. 6A in accordance with one or more embodiments of the disclosure.
Figure 6C:
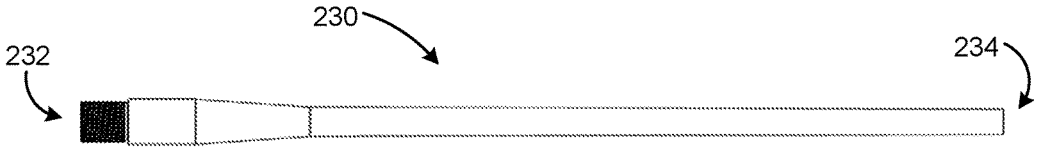
FIG. 6C depicts a side elevation view of the firearm barrel of FIG. 6B in accordance with one or more embodiments of the disclosure.
Figure 7A:
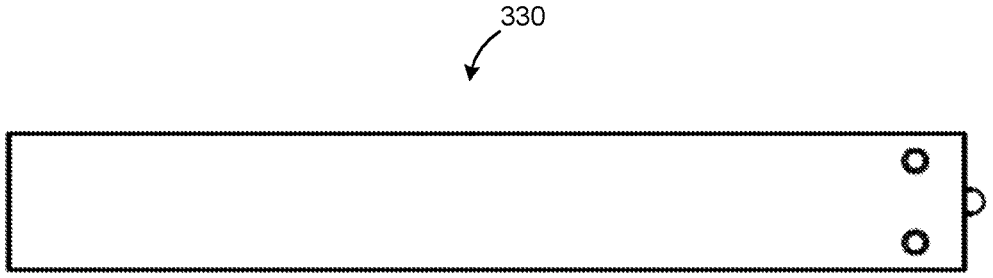
FIG. 7A depicts a side elevation view of yet another firearm barrel configured to accept a firearm cartridge conversion sleeve in accordance with one or more embodiments of the disclosure.
Figure 7B:
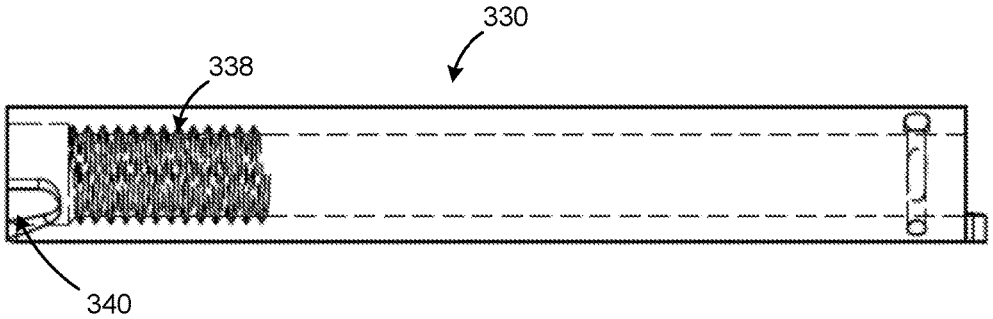
FIG. 7B depicts a cross-sectional view of the firearm barrel of FIG. 7A in accordance with one or more embodiments of the disclosure.
Figure 7C:
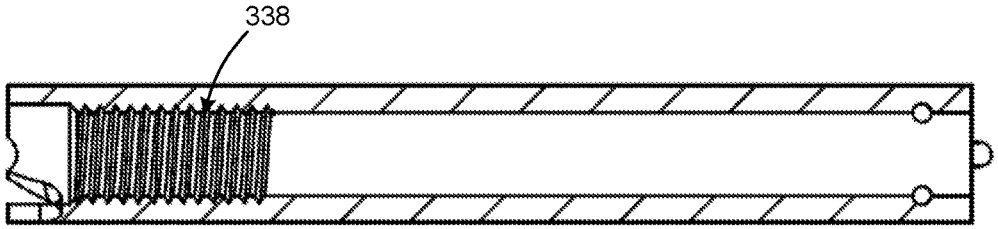
FIG. 7C depicts another cross-sectional view of the firearm barrel of FIG. 7A in accordance with one or more embodiments of the disclosure.
Figure 7D:
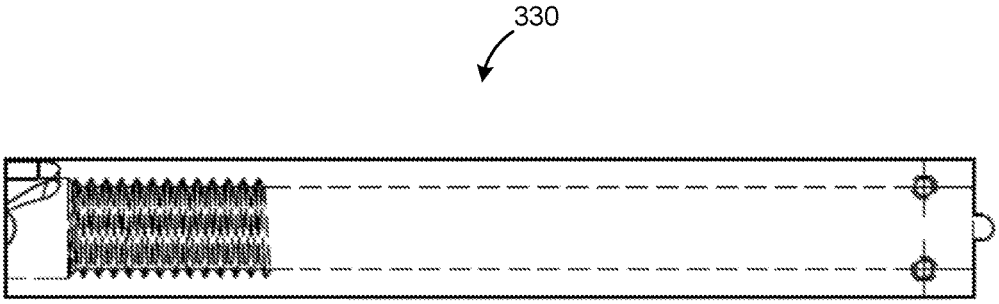
FIG. 7D depicts another cross-sectional view of the firearm barrel of FIG. 7A in accordance with one or more embodiments of the disclosure.
Figure 7E:
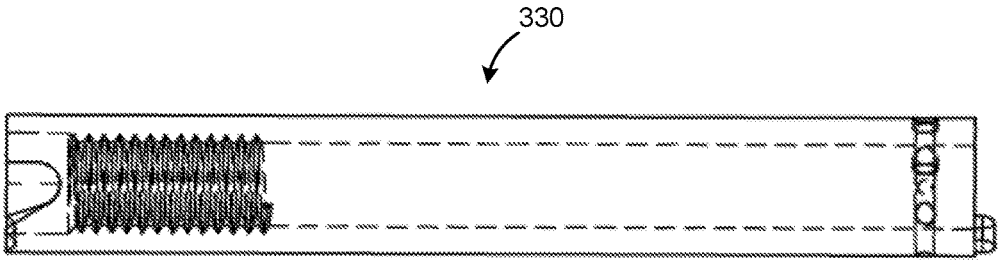
FIG. 7E depicts yet another cross-sectional view of the firearm barrel of FIG. 7A in accordance with one or more embodiments of the disclosure.

In some embodiments, as shown in FIGS. 6A-6C, a firearm conversion sleeve assembly includes a firearm barrel 230 configured to receive a firearm conversion sleeve. For example, the firearm barrel 230 may include a breechface end 232 and a muzzle end 234. In some instances, the breechface end 232 may receive the firearm conversion sleeve described herein. In other instances, the firearm barrel 230 may be configured to receive another type of firearm conversion sleeve. In this manner, the firearm barrel 230 may include a slot 236 configured to engage the firearm conversion sleeve. That is, the slot 236 may include a threaded surface 238 configured to secure a threaded surface on the firearm conversion sleeve. The threaded surface 238 may be disposed anywhere along the surface of the slot 236. Extending from the slot 236 may be a bore extending therefrom to the muzzle end 234 of the firearm barrel 230. In this manner, the bore 124 (e.g., as shown in FIG. 1) diameter at the proximate end 108 may complement the bore within the firearm barrel 230. In this manner, when a firearm is discharged, the bullet may travel from the cartridge within the firearm conversion sleeve towards the muzzle end 234 of the firearm barrel 230.

In some embodiments, as shown in FIGS. 7A-7E, the firearm conversion sleeve may be adapted to fit within a bolt action rifle barrel and/or receiver 330. In some instances, the firearm conversion sleeve may include a notch and/or indentions configured to align with an indentation 340. In other instances, the firearm conversion sleeve may not include a notch and/or indentions configured to align with an indentation. The firearm conversion sleeve may include a threaded outer surface configured to mate with the threaded surface 338 of the receiver 330.

Figure 8A:
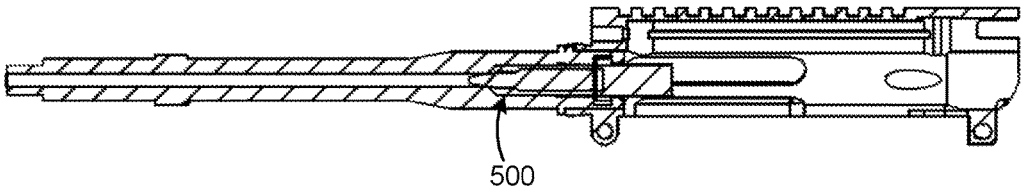
FIG. 8A depicts a cross-sectional view of another firearm barrel able to accept a firearm cartridge conversion sleeve in accordance with one or more embodiments of the disclosure.
Figure 8B:
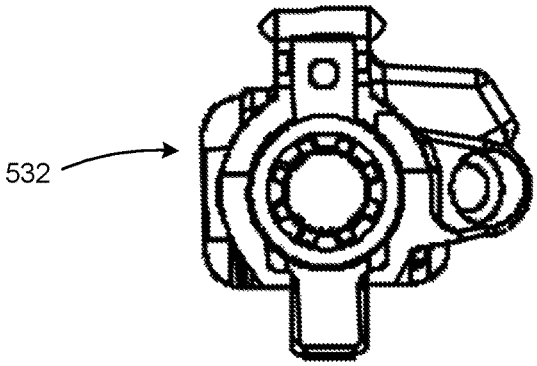
FIG. 8B depicts a plan view of the breechface end of the firearm barrel of FIG. 8A in accordance with one or more embodiments of the disclosure.
Figure 8C:
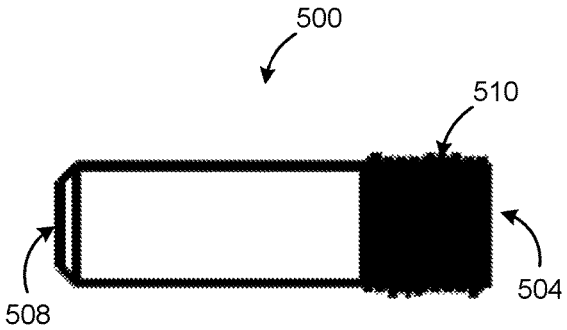
FIG. 8C depicts a side elevation view of a firearm cartridge conversion sleeve in accordance with one or more embodiments of the disclosure.

In some embodiments, as shown in FIGS. 8A-8C, the firearm conversion sleeve 500 may include a threaded outer surface 510 disposed on the distal end 504. The firearm conversion sleeve 500 may be tapered on the proximate end 508. In some instances, the threaded outer surface 510 may be disposed on the proximate end 508. In other instances, the threaded outer surface 510 may be disposed anywhere along the firearm conversion sleeve 500. The firearm conversion sleeve 500 may or may not include a collar. In certain embodiments, the firearm conversion sleeve may be adapted to an AR-15.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed is:

1. A firearm conversion sleeve, comprising:
- a main body comprising a distal end, a body portion, a proximate end, and a bore extending through the main body from the distal end to the proximate end;
- a collar disposed on the distal end of the main body;
- a notch disposed on an outer surface of the collar, wherein the notch extends between the bore and an outer circumference side surface of the collar;
- a threaded outer surface disposed on the main body;
- a first lip defined by the main body and the collar;
- a second lip disposed on the main body adjacent to the threaded outer surface; and
- a tapered surface at the proximate end of the main body.

2. The firearm conversion sleeve of claim 1, further comprising a textured outer surface disposed on at least a portion of an outer surface of the collar.

3. The firearm conversion sleeve of claim 1, wherein the notch is rectangular.

4. The firearm conversion sleeve of claim 1, further comprising an indention disposed along and extending radially inward from an outer circumferential surface of the collar.

5. The firearm conversion sleeve of claim 1, wherein the main body and the collar are substantially cylindrically shaped.

6. The firearm conversion sleeve of claim 1, wherein the main body further comprises a inwardly tapered wall disposed along the proximate end of the main body.

7. A firearm conversion assembly, comprising:
- a firearm comprising:
  - a firearm barrel comprising a breechface end, a muzzle end, and a slot;
- a firearm conversion sleeve comprising:
  - a main body comprising a distal end, a body portion, a proximate end, and a bore extending through the main body from the distal end to the proximate end;
  - a collar disposed on the main body;
  - an indention disposed along and extending radially inward from an outer circumferential surface of the collar;
  - a notch disposed on an outer surface of the collar, wherein the notch extends between the bore and an outer circumference side surface of the collar;
  - a threaded outer surface disposed on the main body;
  - a first lip defined by the main body and the collar;

a second lip disposed on the main body adjacent to the threaded outer surface; and a tapered surface at the proximate end of the main body.

8. The firearm conversion assembly of claim 7, wherein the firearm barrel further comprises a threaded inner surface disposed within the slot of the firearm barrel, and wherein the threaded outer surface of the main body is configured to threadably engage the threaded inner surface of the firearm barrel.

9. The firearm conversion assembly of claim 7, wherein an outer wall of the main body tapers inwardly at the proximate end and an inner wall of the slot tapers outwardly at a first end of the slot.

10. The firearm conversion assembly of claim 7, wherein an outer surface of the firearm conversion sleeve is cylindrically shaped.

11. A firearm conversion assembly, comprising:

a firearm comprising:

a firearm barrel comprising: a breechface end, a muzzle end, and a slot; and a threaded inner surface disposed within the slot; and a firearm conversion sleeve comprising:

a main body comprising a distal end, a body portion, a proximate end, and a bore extending through the main body from the distal end to the proximate end;

a collar disposed on the distal end of the main body;

a notch disposed on an outer surface of the collar, wherein the notch extends between the bore and an outer circumference side surface of the collar;

a threaded outer surface disposed on the main body;

a first lip defined by the main body and the collar;

a second lip disposed on the main body adjacent to the threaded outer surface; and a tapered surface at the proximate end of the main body.

12. The firearm conversion assembly of claim 11, wherein the firearm conversion sleeve is cylindrical.

13. The firearm conversion assembly of claim 11, wherein the threaded outer surface is disposed along at least a portion of the main body adjacent the distal end.

14. The firearm conversion assembly of claim 11, wherein the threaded outer surface is disposed along at least a portion of the main body adjacent the proximate end.

* * * * *